United States Patent [19]

Arneson et al.

[11] 3,986,658

[45] Oct. 19, 1976

[54] ARTICLE CARRIER

[75] Inventors: Edwin L. Arneson, Hillsdale, N.J.; Guelfo A. Manizza, Blauvelt, N.Y.

[73] Assignee: Federal Paper Board Company, Inc., Montvale, N.J.

[22] Filed: June 11, 1973

[21] Appl. No.: 368,825

[52] U.S. Cl. ..... 229/40; 229/15; 229/28 BC

[51] Int. Cl.[2] ..... B65D 5/02; B65D 5/48

[58] Field of Search ..... 229/40, 28 BC, 52 BC, 229/29 E, 15; 206/175, 180, 186, 187

[56] References Cited

UNITED STATES PATENTS

| | | | |
|---|---|---|---|
| 1,871,617 | 8/1932 | King | 229/15 X |
| 2,351,528 | 6/1944 | Lupton | 229/28 BC X |
| 3,263,893 | 8/1966 | Weiss | 229/15 |
| 3,283,989 | 11/1966 | De Paul | 229/15 |
| 3,384,289 | 5/1968 | Grant | 229/15 |
| 3,432,029 | 3/1969 | Brown | 229/40 X |
| 3,556,386 | 1/1971 | Ganz | 229/40 |
| 3,589,593 | 6/1971 | Weiss | 229/40 |
| 3,688,972 | 9/1972 | Mahon | 229/40 X |

*Primary Examiner*—Stanley N. Gilreath
*Attorney, Agent, or Firm*—Guy A. Greenawalt

[57] ABSTRACT

An article carrier for bottled beverages or similar articles which is characterized by a generally rectangular blank of paperboard or similar foldable sheet material cut and scored so that it may be folded and its opposite ends connected to form a sleeve for encompassing a row assembly of the articles with connected side and end wall panels disposed about the sides and ends of the assembly, and having a pair of bottom wall forming panels hinged to the bottom edges of the side wall panels which are overlapped and connected to form the bottom wall, together with a pair of top wall panels hinged to the top edges of the side wall panels which are overlapped and connected to form a top wall. In one form of the carrier the end walls terminate short of the top wall and in another form thereof the end walls extend to the top wall to form a complete enclosure. An internal article separating partition panel structure is provided with a hinged anchoring tab on the bottom edge which is foldable so as to be trapped between the bottom of an article and the bottom wall of the carrier.

1 Claim, 11 Drawing Figures

ARTICLE CARRIER

This invention relates to packaging and is more particularly concerned with improvements in a carton or package structure of the type which is especially adapted for packaging bottled beverages or similar articles.

In the packaging of certain articles, particularly, bottled beverages and like products, two different type packages have been employed most often, in commercial operations. In one type of packaging unit, which has been used extensively, an assembly of bottles, generally in double row arrangement is encased in a sleeve-like tubular container which is formed by a generally rectangular paperboard blank, cut and scored so that it may be wrapped about the top, bottom and sides of the assembly of bottles. The ends of the wrapper forming blank are connected by an adhesive or by interlocking tab elements so as to confine the bottles therein. A typical package unit of this wraparound type is disclosed in U.S. Pat. No. 3,589,593, granted June 29, 1971, to Arthur J. Weiss, wherein the end portions of the blank are folded beneath a double row of bottles and connected by locking and latching elements in the bottom forming panel at one end of the blank which are engaged in co-operating apertures in an underlying portion of the bottom wall forming panel at the other end of the blank. The latching elements are in the form of tabs which are turned upwardly between pairs of bottles so as to form a bottle separating means. In another similar type of wraparound packaging unit where more extensive separation of the bottles is required, a separator panel has been employed as described in U.S. Pat. No. 3,263,893, granted to Arthur J. Weiss. A somewhat different type of bottle carrier package unit, which has also been used extensively, is in the form of a basket with connected bottom, side and end walls and a bottle receiving and separating cell structure which includes a longitudinal center partition with a handle forming portion and cross partition members which are spaced on each side thereof so as to provide a multi-cell arrangement in which the bottles are loaded by dropping them into the cells through the open tops thereof. A typical carrier package of this type is disclosed in U.S. Pat. No. 3,184,102, granted to Edwin L. Arneson. Carrier packages of the basket type have most often been used for packaging soft drinks where a substantial portion of the bottles may be exposed and there is no need to protect the bottle contents from the deleterious effects of light as may be the case with bottled beer. To wraparound-type and the basket-type package units have both been used commercially, in large numbers, over a long period and each of these two general types has some features which are recognized as advantageous in packaging particular products while other features may not be considered so desirable. It is a general object of the invention to provide a carrier-type package wherein the container is constructed so as to embody desirable features of both the previously designed basket carriers and wraparound package units while at the same time the containers may be produced economically and applied to assemblies of bottles with little change in existing machinery.

A more specific object of the invention is to provide an article carrier for bottled beverages or similar articles which is formed from an elongated blank cut and scored so as to divide the same into panels which are folded and connected to form a container in collapsed form, with pairs of top and bottom forming panels adapted to be connected after the collapsed carrier is opened up into tubular form and assembled on a group of bottles so as to form a package in which the bottles are surrounded on all six sides thereof.

A further object of the invention is to provide an article carrier for bottled products or the like which comprises connected side and end wall panels and a pair of bottom wall forming panels which are hinged to the bottom edges of the opposed side wall panels and having overlapping marginal portions which are cut and scored to provide hinged latching and locking elements on the outside marginal portions and co-operating apertures for receiving the latching and locking elements on the inside marginal portions and with relatively small apertures at the hinged connection with the side wall and bottom wall forming panels for receiving compression fingers on a bottle packaging machine so as to hold the bottom wall panels in proper relation for engaging the locking and latching elements in the apertures.

Another object of the invention is to provide a carrier-type package especially suitable for packaging bottled beverages or the like wherein an assembly of bottles or similar articles is enclosed in a container forming wrapper which comprises connected side and end wall forming panels disposed about the sides and ends of the bottle assembly, a pair of bottom wall forming panels hinged to the bottom edges of the side wall forming panels and a pair of top wall forming panels hinged to the top edges of the side wall forming panels and folded into top wall forming relation with overlapping marginal portions which include a hinged locking panel on one of said pair of panels having locking elements and co-operating latching elements spaced along opposite edges thereof, respectively, which locking and latching elements are received in spaced apertures in an underlying marginal portion of the other one of said pair of top wall forming panels and finger holes for gripping the package which are disposed in areas of the locking panel between the spaced locking and latching elements.

Still another object of the invention is to provide a carrier package for bottled beverages or similar articles wherein a double row assembly of bottles is enclosed in a wrapper disposed about the top, bottom and sides thereof with a panel structure separating the bottles which includes an anchoring tap hinged to a bottom edge of the separator panel and folded so as to lie on the bottom wall beneath one of the bottles thereby holding the separator panel against upward displacement.

These and other objects and advantages of the invention will be apparent from a consideration of the several forms of the article carrier which are illustrated in the accompanying drawings wherein.

Figure 5:
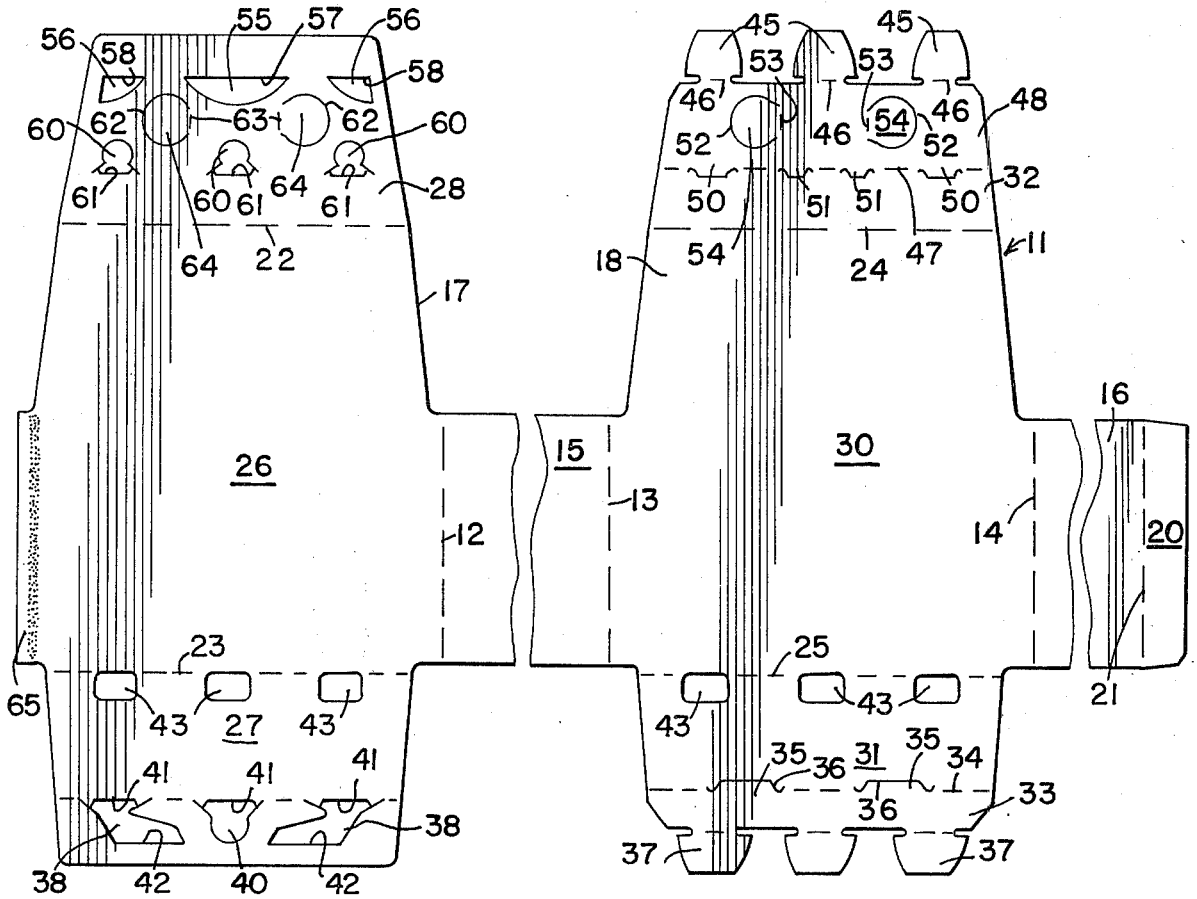
FIG. 5 is a plan view, with portions broken away, showing a paperboard blank which is cut and scored for fabricating the package of FIG. 1.
Figure 6:
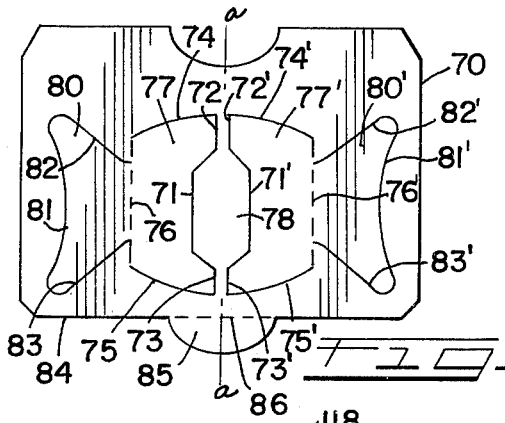
FIG. 6 is a plan view, to a reduced scale, of a paperboard blank which is cut and scored for incorporation in the package of FIG. 1 so as to provide for separation of the body portions of the bottles in the assembly which would otherwise be in contact.

Referring first to FIGS. 1 to 4 of the drawings, there is illustrated a carrier-type package unit 10 in which a plurality of beverage bottles B, arranged in double row formation with transversely aligned pairs, are enclosed in a carton C which has side and end wall forming panels encircling the sides and ends of the bottle assembly and pairs of top and bottom wall forming panels which are hinged to the top and bottom edges of the side wall forming panels and folded into position and connected to provide the carton top and bottom walls. The carton C is fabricated from the cut and scored blank which is illustrated in FIG. 5. The bottles B are separated by an internal separator or partition structure formed by the cut and scored blank which is illustrated in FIG. 6.

Figure 1:
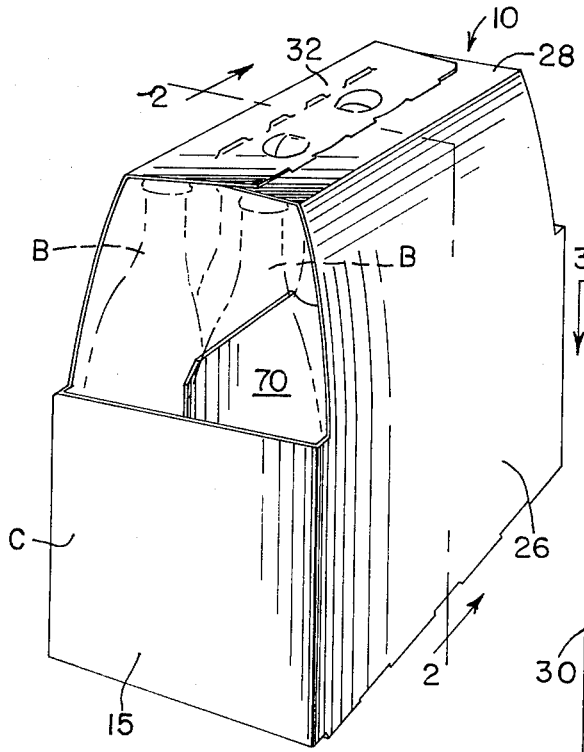
FIG. 1 is a perspective view of a carrier package unit for an assembly of bottles which embodies therein the principal features of the invention.

The carton structure C shown in FIG. 1 will be best understood by reference first to the cut and scored blank 11 which is preferably formed from paperboard or similar material of suitable gauge or weight and which is cut and creased or scored as shown in FIG. 5. The blank 11 is divided by transversely extending, longitudinally spaced score lines 12, 13 and 14 into two end wall forming panels 15 and 16 and two laterally extended blank sections 17 and 18. The end wall panel 18 is extended to provide a glue strip 20 which is separated therefrom by a transverse score line 21. The blank sections 17 and 18 are subdivided by transversely spaced score lines 22, 23 and 24, 25 so as to divide the section 17 into a side wall forming panel 26, a bottom wall forming panel 27, a top wall forming panel 28 and to divide the section 18 into a side wall forming panel 30, a bottom wall forming panel 31 and a top wall forming panel 32. The panel sections 17 and 18 are separated by the end wall forming panel 15 and are cut to provide a similar configuration with the score lines 24 and 25 of the section 18 corresponding to and being aligned with the score lines 22 and 23, respectively, in the section 17. This provides wall panels 26 and 30 with identical shape and size, which panels are separated by score lines 23 and 25 from the bottom wall forming panels 27 and 31, the latter being spaced along the one side of the blank. The panels 26 and 30 are separated by score lines 22 and 24 from the top wall panels 28 and 32, and the latter are spaced along the opposite side of the blank and aligned with the bottom wall panels 27 and 31, respectively. The longitudinally spaced blank sections 17 and 18 extend laterally on opposite sides of the blank and have their laterally extending side edges tapered outwardly and toward each other so as to provide maximum nesting on each side of the blank when the blanks are cut from a wide web.

The bottom wall forming panels 27 and 31 are cut and scored to provide a fastening means in overlapping marginal portions when the panels 27 and 31 are hinged about the score lines 23 and 25 into overlapping bottom wall forming relation during the formation of the package. The panel 31 is cut and scored to provide a relatively narrow marginal locking strip 33 which is separated from the remainder of the panel by the hinge forming score line 34. A plurality of locking tabs 35 are provided in longitudinally spaced relation along the score line 34 by generally U-shaped cutting lines 36. A plurality of latching tabs or fingers 37 are provided in spaced relation on the outer edge of the locking strip 33.

Apertures 38 and 40 are provided in the marginal portions of the other bottom wall forming panel 27 which are spaced according to the spacing of the locking tabs 35 and latching fingers 37 so as to provide abutment edges 41 and 42 for co-operating with the locking tabs 35 and latching fingers 37 in securing the two panels together.

Both bottom wall forming panels 27 and 31 are provided along the hinge forming score lines 23 and 25 with a plurality of spaced apertures 43 which adapt the blank for use on a bottle packing machine of the type having internal compression fingers such as disclosed in U.S. Pat. No. 3,474,590, granted Oct. 28, 1969 to Robert H. Ganz.

The top wall forming panels 28 and 32 on the opposite side of the blank are cut and scored to provide a means for fastening these panels together when they are hinged about the score lines 22 and 24 into overlapping top wall forming relation during the formation of the package. The outer marginal portion of the panel 32 is cut to provide a plurality of spaced latching fingers 45 which extend from the longitudinal base forming score lines 46 on which they are hinged and which are spaced outboard a substantial distance from a parallel score line 47 so as to define therebetween a hinged latching and locking panel 48 of substantial width. A plurality of locking tabs 50 and 51 are formed along the score line 47 with the tabs 50 at opposite ends being aligned transversely with the latching fingers 45 and with a pair of intermediate tabs 51 of smaller size being opposite the middle latching finger 45. Locking tabs 50 and 51 are formed by generally U-shaped cuts which extend from the score line 47 in the direction of the longitudinal center of the blank. The locking tab elements 35, 50, 51 and latching elements 37, 45 may be as described in detail in U.S. Pat. No. 3,589,593, granted June 29, 1971, to Arthur J. Weiss. The panel 48 has cut therein a pair of finger holed, with the material being cut on generally C-shaped lines 52 which extend in opposite directions from parallel, spaced, transverse hinge forming score lines 53 and providing reinforcing tabs 54 which hinge inwardly of the package on the score lines 53. The other top wall forming panel 28 has cut therein longitudinally spaced apertures 55 and 56. These apertures, which comprise center aperture 55 and end apertures 56 are located so as to receive in the center aperture 55 the pair of small locking tabs 51 and in the outer apertures 56 the larger locking tabs 50. The apertures 55 and 56 provide aligned straight abutment edges 57 and 58 for co-operation with the tabs 51 and 50. Apertures 60 are cut in the panel material which are spaced longitudinally according to the spacing of the latching fingers 45 in the panel 28 so as to provide abutment edges 61 for co-operation with the latching fingers 45, the apertures 60 being spaced transversely relative to the apertures 55 and 56 according to the spacing between the locking tabs 50, 51 and the latching fingers 45 on the locking and latching strip 48. The locking and latching apertures 55, 56, 60 and also apertures 38, 40 may have a different configuration but otherwise they are cut so as to co-operate with the respective locking and latching elements in securing the panels together in the same manner as the corresponding locking and latching apertures described in U.S. Pat. No. 3,589,593. Finger holes are formed in the area between the apertures 55, 56 and 60, 61 by cutting on a pair of generally C-shaped lines 62 which extend in opposite directions from score lines 63 and which define with the latter a pair of hinged tabs 64. The hinged tabs 64 are positioned so as to underlie the hinged tabs 54 when the panels 28 and 32 are overlapped. Thus the finger holes and reinforcing tabs 54, 64 are disposed in the center of the top wall and the latter provide double thickness reinforcing in the areas adjacent the finger holes.

Figure 2:
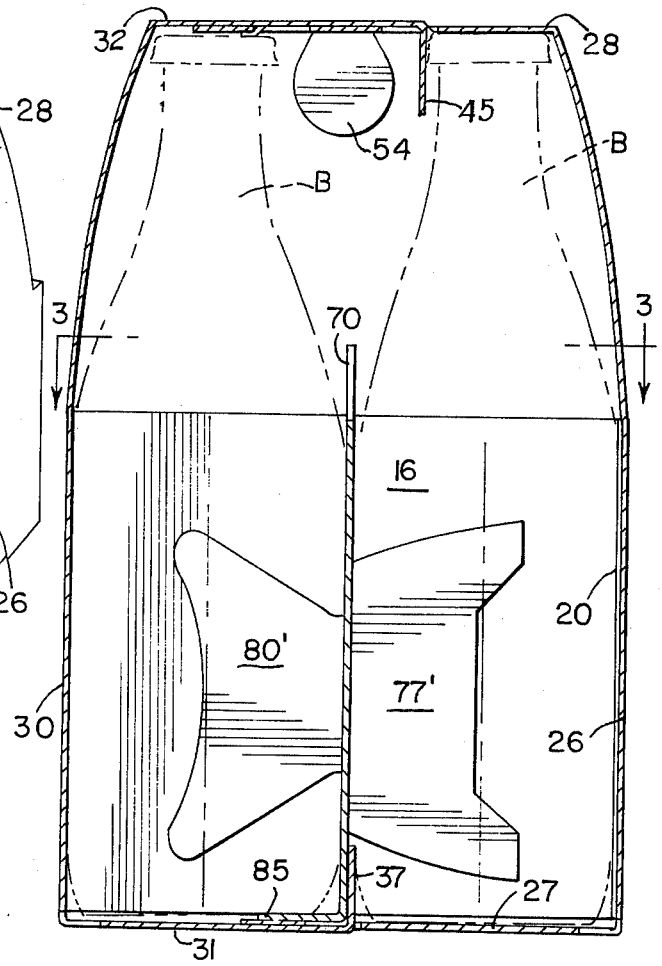
FIG. 2 is a cross sectional view taken on the line 2—2 of FIG. 1, to an enlarged scale.
Figure 4:
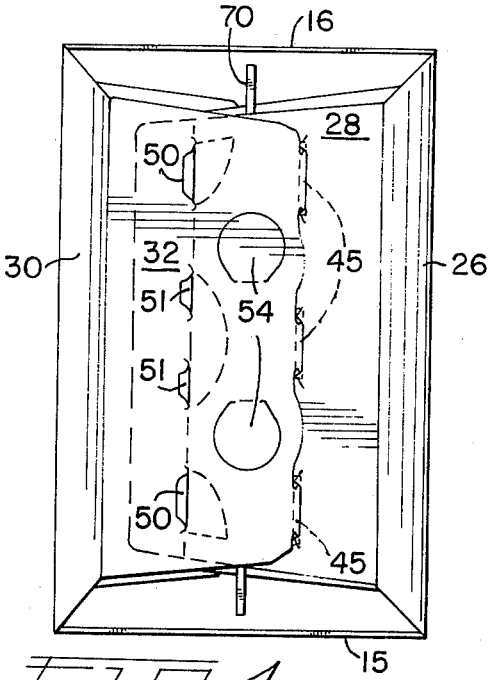
FIG. 4 is a top plan view of the package unit shown in FIG. 1.
Figure 3:
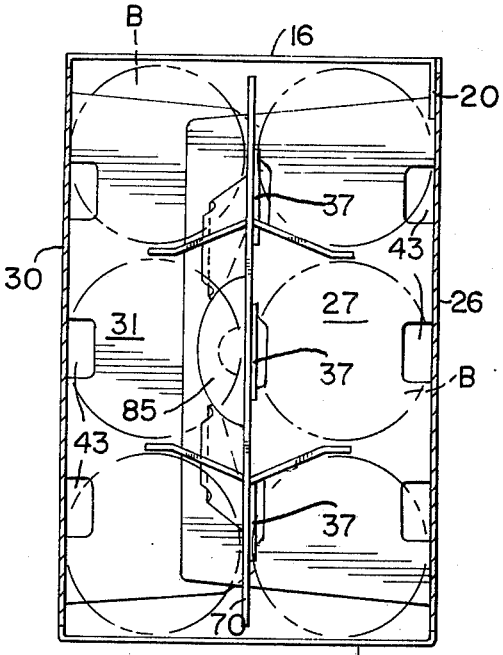
FIG. 3 is a sectional view, to a smaller scale, taken on the line 3—3 of FIG. 2.

The fabrication of the container or carton C from the cut and scored blank 11, in knocked down condition, is accomplished by folding the end panel 16 about the score line 14, applying the glue to the exposed top face of the glue strip 20 and thereafter folding the blank section 17 about the score line 12 so as to bring the edge portion 65 of the panel 26 into overlying relation with the glue strip 20. In this condition, the collapsed carton is supplied to the bottling plant where it is opened up into tubular form and telescoped down over an assembly of the bottles B in double row, transversely paired alignment. The bottom wall forming panels 27 and 31 are folded about the score lines 23 and 25 and the locking panel 33 is manipulated to bring the locking tabs 34 and latching fingers 37 into interengaging relation in the apertures 38 and 40. Top wall forming panels 28 and 32 are folded about the score lines 22 and 24 and the locking panel 48 is manipulated to bring the locking tabs 50 and 51 into the apertures 55, 56, and the latching fingers 45 into the apertures 60 so as to interconnect the panel portions and form the top wall. The latching fingers 45 are disposed normal to the panel 48 and bear against the bottle closure caps as shown in FIG. 2. The finger openings in the latching panel 48 lie in the area between the locking tabs 50, 51 and latching fingers 45 and are provided with reinforcing tabs 54, 64 which form four thicknesses of material when the tabs 54, 64 are turned inwardly against the inner face of the innermost top wall forming panel 28.

To comply with shipping requirements for certain products, the package may be provided with a bottle separator or partition forming panel structure, the blank for which is illustrated at 70, in FIG. 6. The partition or separator blanks 70 is generally rectangular in shape with a longitudinal dimension somewhat less than the corresponding dimension of the carton C and no less than the distance between transverse planes extending through the end bottles. The height of the blank 70 relative to the height of the carton will be determined by the height of the main body portions of the bottles so that when in proper vertical position it will serve to separate the otherwise contacting body portions of the bottles. The blank 70 is cut and scored as shown in FIG. 6 and is symmetrical about the center line *s1—1*. A central portion of the blank is provided with two generally C-shaped or U-shaped cutting lines 71 and 71' which are identical except for being in back-to-back relation. The cutting lines 71, 71' are spaced from each other and terminate at opposite ends at relatively small extensions 72, 73 and 72', 73' which are in parallel spaced relation and which terminate in turn at longitudinally extending curved cutting lines 74, 75 and 74', 75', the latter extending to transverse score lines 76 and 76' which are spaced in the direction of the ends of the blank. The aforesaid cutting and scoring lines define bottle separating panels 77 and 77' which are on opposite sides of the center line *a—a* and between them provide a center bottle separating panel 78. A further set of bottle separating panels 80 and 80' are formed in opposite ends of the blank which extend transversely of the blank and outwardly of the transverse hinge forming score lines 76 and 76' in the direction of the ends of the blank. The panels 80 and 80' are formed by cutting on transverse lines 81 and 81' which have a semi-circular configuration and face in opposite directions and which terminate at opposite ends and join cutting lines 82, 83 and 82', 83', the latter extending to points on the transverse score lines 76, 76' which are spaced inwardly of the juncture of the cutting lines 74, 75 and 74', 75' with the lines 76, 76'. The panels 77 and 77' are integral with the panels 80 and 80', respectively, and the double panel units or sections hinge about the score lines 76 and 76' so as to provide for separation of the bottles in the two rows on opposite sides of the member 70 in the operative position of the latter. The blank 70 is provided along the one longitudinal side edge 84 with a small semi-circular tab 85 which is adapted to hinge on the score line 86 into a plane normal to the plane of the body of the blank 70. Except for the longitudinal and transverse dimensions, which depend upon the dimensions of the bottles, and the tab 84 the separator panel may be cut in accordance with the disclosure in U.S. Pat. No. 3,263,893, granted Aug. 2, 1966, to Arthur J. Weiss.

The separator structure 70 may be assembled with the bottles B after the separator panels 77, 80 and 77', 80' are pivoted or swung about the hinge lines 76 and 76' into generally parallel planes which are transverse to the plane of the main body of the blank 70. The separator structure is dropped down between the bottles so that the main body of the blank 70 is between the two rows while the hinged separator panels 77, 80 and 77', 80' are between the bottles in the respective rows. The anchoring tab 85 is trapped between the bottom of a bottle and the top face of the inner bottom wall forming panel 27 when the panels 27 and 31 are closed as shown in FIG. 2.

The carton or container C is dimensioned so as to form a relatively tight enclosure about the assembly of bottles B. The top portions of the end walls are open and the side walls curved inwardly towards the top wall so as to assume in part the contour of the upper portions of the bottles. There is adequate provision for picking up the package unit by inserting the fingers in the tab reinforced finger holes on the top wall. Where required, the bottles are separated in a satisfactory manner by the separator or divider blank structure 70 and this structure is anchored so as to prevent it from climbing upward to an inoperative position by means of the turned over tab 85 which is captured between the bottom of a bottle and the inner face of the bottom wall.

Figure 7:
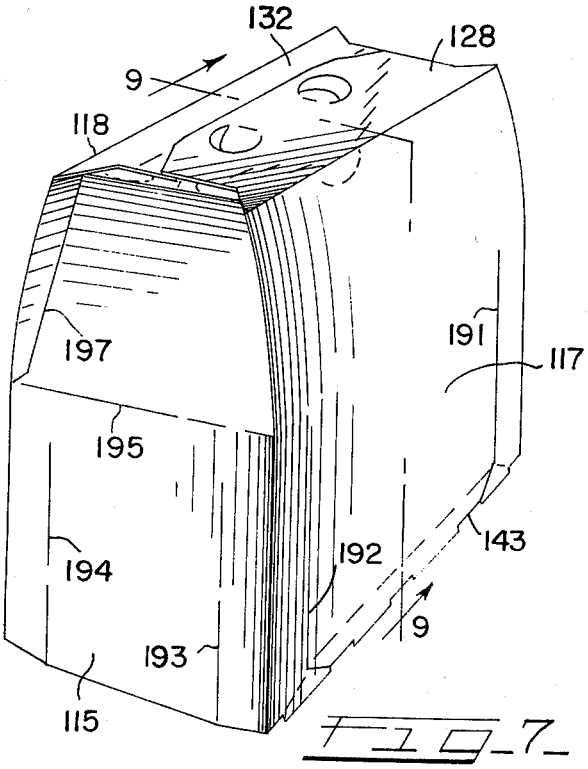
FIG. 7 is a perspective view similar to FIG. 1 showing a modified form of the package unit.

A modified form of the carrier package unit is illustrated at 110 in FIG. 7 of the drawings. This form of the package is designed particularly for packaging products, such as, bottled beer where it is necessary or desirable to completely enclose the bottles so as to avoid the deleterious effect of light on the product.

Figure 11:
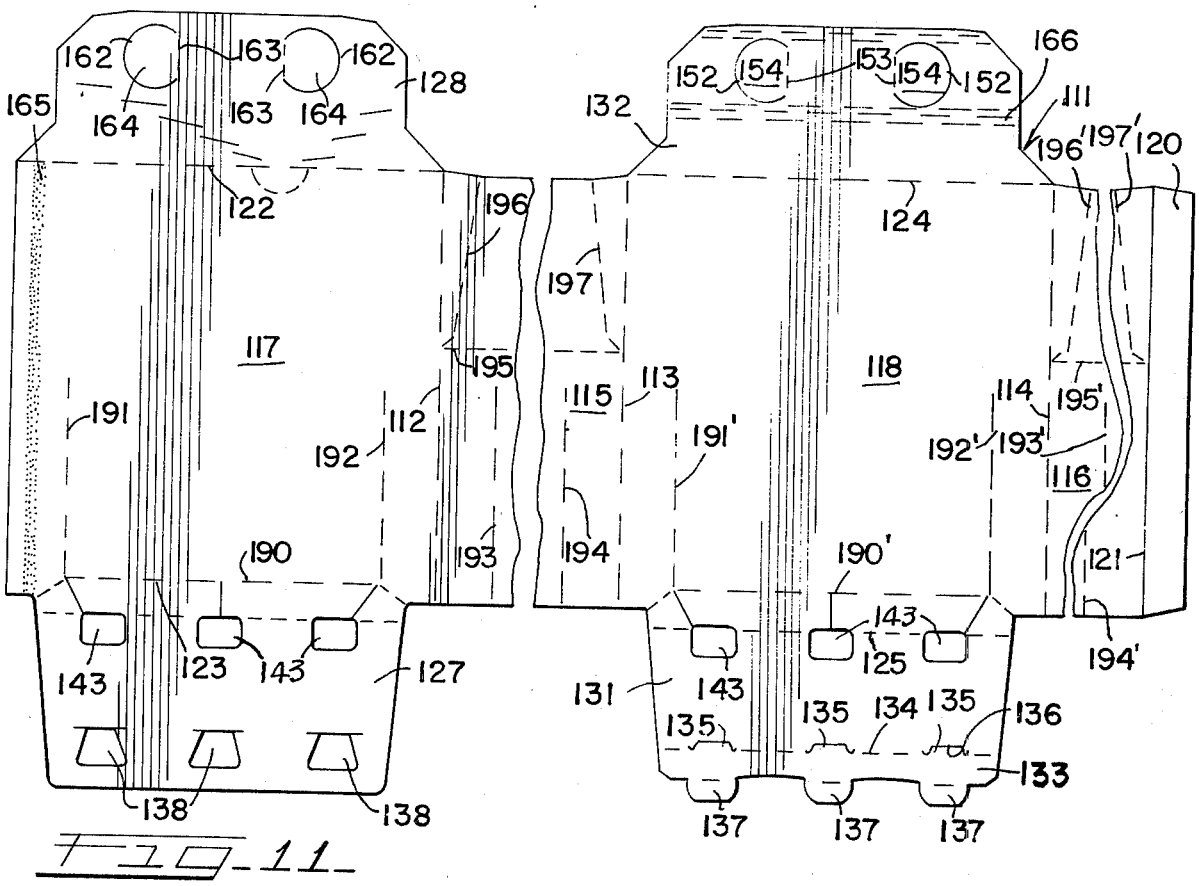
FIG. 11 is a plan view, with portions broken away, of a paperboard blank which is cut and scored for fabricating the package unit of FIG. 7.

The package unit 110 is fabricated by enclosing an assembly of the bottles B in a cut and scored blank 111 which is shown in FIG. 11. The blank 111 is divided by transverse score lines 112, 113 and 114 into end wall panels 115 and 116 and side wall panels 117 and 118. In this form of the blank the end wall panels 115 and 116 have substantially the same transverse dimension as the side wall panels 117 and 118. The side wall panels 117 and 118 are extended at opposite sides of the blank and these blank sections are subdivided by longitudinal score lines 122, 123 and 124, 125 so as to provide along one side of the blank bottom wall forming panels 127, 131 and along the opposite side of the blank top wall forming panels 128 and 132. The end wall forming panel 116 is extended to form a glue strip 120 which is separated from the panel by the score line 121.

The one bottom wall forming panel 131 has an outer marginal portion cut and scored to provide a locking and latching panel 133 which is separated from the main portion of the panel 131 by a longitudinal score line 134 and which has spaced along the score line 134 a plurality of locking tabs 135 formed by generally C-shaped or U-shaped cutting lines 136. Latching fingers 137 are formed along the outer edge of the blank which are aligned transversely with the locking tabs 135. The other bottom wall forming panel 127 is provided with longitudinally spaced apertures 138 which are of truncated triangular shape and spaced longitudinally according to the spacing of the locking tabs 135 and latching fingers 137. The apertures 138 are located transversely of the blank so as to receive the locking tabs 135 and the latching fingers 137 when the panels are overlapped in forming the bottom wall of the carton and the locking panel is manipulated to lock the panels together. Each of the bottom wall panels 127 and 131 is provided along its respective score lines 123 and 125, which separates the same from the side wall panels 117 and 118, with a plurality of apertures 143 of generally rectangular shape which adapt the blank for use with a packaging machine of the type disclosed in U.S. Pat. No. 3,474,590.

Figure 8:
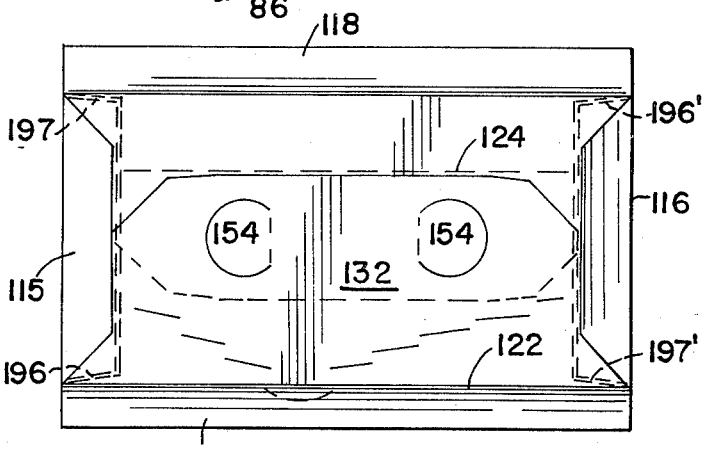
FIG. 8 is a top plan view of the package of FIG. 7.
Figure 9:
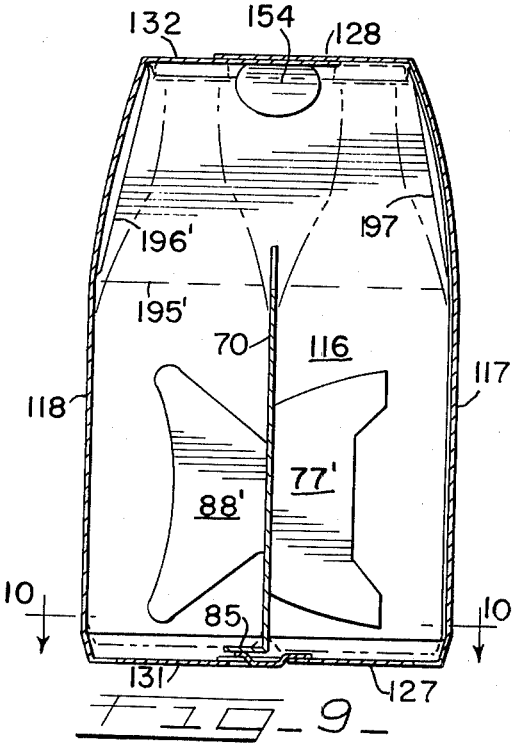
FIG. 9 is a cross sectional view taken on the line 9—9 of FIG. 7, to an enlarged scale.

The top wall forming panels 128 and 132 have a dimension transversely of the blank sufficient to bring the marginal portions into overlapping relation throughout a relatively wide area so as to permit a pair of finger holes being cut in an area of double thickness of material. The finger holes are provided by cutting in the panel 132 on the generally C-shaped lines 152 with these lines extending in opposite directions from spaced parallel score lines 153 which are spaced transversely and longitudinally so as to come between the tops of the bottles in the assembly enclosed, as shown in FIGS. 8 and 9. Cutting and scoring on lines 152 and 153 results in hinged tabs 154 for reinforcing the finger holes. The other top wall forming panel 128 is provided with a pair of finger holes by cutting on the lines 162 which terminate at the hinge forming score lines 163 and thereby form the finger hole tabs 164 with the tabs being located so as to overlie the tabs 154 in the panel 132 when the package is formed.

The side wall forming panels 117 and 118 are each provided with a set of longitudinal and transverse score lines 190, 191 and 192 on panel 117 and 190′, 191′ and 192′ on panel 118 to enable the formation of a relatively tight, compact contour-type package. The end wall forming panels 115 and 116 have score lines 193, 194 and 193′, 194′ in their lower portions for the same purpose. In the upper end wall forming portion of each of the end wall forming panels 115 and 116 there is provided a score line 195, 195′ extending longitudinally of the blank and a pair of converging score lines 196, 197 and 196′, 197′ which extend transversely of the blank, enabling the top portions of the panels to swing inwardly to the position shown in FIG. 7 when the package is formed.

The cut and scored blank 111 is initially formed into a flattened container structure and thereafter applied to an assembly of bottles to form the package of FIG. 7 in the same manner as described with reference to the fabrication of the package shown in Fig. 1. Adhesive is applied to the panel 117 as shown at 165 and the blank is folded about the lines 114 and 112 to form the collapsed container or carton which is subsequently squared up into tubular form and placed over an assembly of bottles with the bottom wall forming panels 127, 131 hinged to closed position and the locking and latching panel 133 manipulated to connect the two panels in bottom wall forming relation. The top wall forming panels 128 and 132 are supplied with an adhesive as indicated at 166 and folded upon each other to form the top wall. The top portions of the end walls are swung inwardly toward each other as the top wall forming panels 128 and 132 are brought into final position with the margins overlapping and the finger hole reinforcing tabs 164 overlying the finger hole tabs 154.

Figure 10:
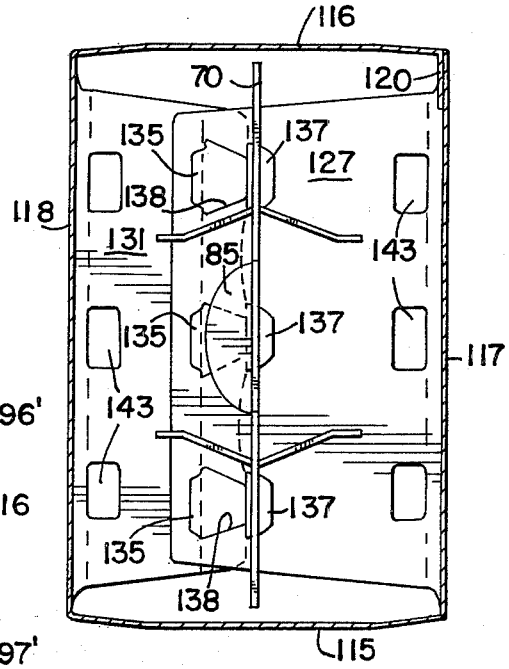
FIG. 10 is a sectional view taken on the line 10—10 of FIG. 9.

While the package illustrated in FIG. 7 may be used without an internal bottle separating structure, when it is deemed necessary or desirable, an internal divider or separator structure, of the same character as shown in FIG. 6 and employed in the package of FIG. 1, may be incorporated in the package of FIG. 7 as illustrated in FIGS. 9 and 10.

The package structure of FIGS. 9 to 11, as shown, has the top wall thereof formed by a pair of panels which are overlapped and connected by an adhesive. The package may be formed with the top wall panels cut and scored so as to provide interlocking connecting elements of the same character as illustrated in the formation of the package of FIGS. 1 to 6.

We claim:

1. The article carrier type package which comprises an assembly of articles having the general shape of bottles arranged in double row relation and a container formed from a single cut and scored blank of foldable sheet material, said container including hingedly connected side and end wall forming panels disposed in tube forming relation about the sides and ends of the article assembly, bottom wall forming panels hinged to the bottom edges of said side wall forming panels and folded into engagement with the bottom face of the article assembly, which bottom wall forming panels have interengaging locking and latching elements comprising spaced locking and latching members on one of said bottom wall forming panels and co-operating spaced apertures in a marginal portion of the other bottom wall forming panel in which the locking and latching members are engaged, and top wall forming panels hinged to the top edges of the side wall panels and folded into top wall forming relation, which top wall forming panels have interengaging locking and latching elements comprising locking and latching members on the one top wall forming panel and cooperating spaced apertures in the other top wall forming panel in which the locking and latching members are engaged, said top wall forming panels being dimensioned and connected by engagement of said locking and latching members in said apertures so that said top wall forming panels are engaged with the tops of said articles and finger holes which are cut therein are spaced along the longitudinal center line of the top wall and extend through overlapping areas of said top wall forming panels, and an article separating device disposed in said container which is in the form of a generally rectangular single ply panel member positioned in a vertical plane between the rows of articles and having a vertical dimension substantially less than the over-all vertical dimension of the articles and the internal vertical dimension of the container, said article separating panel member forming an upstanding separator between otherwise contacting side wall portions of the articles in the double row, said panel member having cross partition members cut therefrom and extending laterally of the plane thereof which cross partition members are disposed between the articles in the rows and form separators preventing article contact, and said article separating panel member having an integrally hinged tab member on the bottom edge thereof which is folded normal to the plane of said upstanding panel member and which extends beneath the bottom of an article in the container and in flat engagement with the container bottom wall so that said panel member is held against upward movement relative to the articles.

* * * * *